US008590706B2

(12) United States Patent
Alvarado et al.

(10) Patent No.: US 8,590,706 B2
(45) Date of Patent: Nov. 26, 2013

(54) PACKS OF PLASTIC BAGS AND RACKS FOR SUPPORTING PACKS OF PLASTIC BAGS

(76) Inventors: Alejandro J. Alvarado, Houston, TX (US); Pedro A. Monterrosa, Houston, TX (US)

( * ) Notice: Subject to any disclaimer, the term of this patent is extended or adjusted under 35 U.S.C. 154(b) by 0 days.

(21) Appl. No.: 13/472,386

(22) Filed: May 15, 2012

(65) Prior Publication Data

US 2012/0228246 A1 Sep. 13, 2012

Related U.S. Application Data

(62) Division of application No. 12/283,871, filed on Sep. 16, 2008, now Pat. No. 8,210,354.

(60) Provisional application No. 60/993,832, filed on Sep. 14, 2007.

(51) Int. Cl.
*B65D 1/34* (2006.01)

(52) U.S. Cl.
USPC ..... 206/554

(58) Field of Classification Search
USPC ..... 206/554; 211/12, 59.1, 59.2; 221/45, 221/63, 59.2, 282, 283, 305; 248/100; 383/9, 12, 13, 37
See application file for complete search history.

(56) References Cited

U.S. PATENT DOCUMENTS

| | | | | |
|---|---|---|---|---|
| 3,306,492 | A * | 2/1967 | Kugler | 206/554 |
| 4,487,318 | A * | 12/1984 | Roen | 206/554 |
| 5,857,586 | A * | 1/1999 | Scherr | 206/554 |
| 5,863,130 | A * | 1/1999 | Nguyen | 206/554 |
| 5,881,882 | A * | 3/1999 | Fletcher et al. | 206/554 |
| 2005/0047685 | A1 * | 3/2005 | Tsutsumi | 206/554 |
| 2005/0103679 | A1 * | 5/2005 | Smithson | 206/554 |
| 2006/0072856 | A1 * | 4/2006 | Su et al. | 206/554 |
| 2006/0283764 | A1 * | 12/2006 | Tan | 206/554 |

* cited by examiner

*Primary Examiner* — Luan K Bui

(57) ABSTRACT

A pack of bags with a sleeve that provides an envelope for the pack of bags is disclosed. In the plurality of bag units in the pack of plastic bags, each front sheet and back sheet is cut to form an opening and a grab tab for each bag. A tongue may be inserted in the opening to push forward the grab tab when the pack of plastic bags is suspended from a rack.

2 Claims, 13 Drawing Sheets

PACKS OF PLASTIC BAGS AND RACKS FOR SUPPORTING PACKS OF PLASTIC BAGS

RELATED APPLICATIONS

This application is a divisional of U.S. application Ser. No. 12/283,871, filed Sep. 15, 2008, now U.S. Pat. No. 8,210,354, entitled "Packs of Plastic Bags and Racks for Supporting Packs of Plastic Bags" which claims the benefit under 35 U.S.C. 119(e) of the U.S. provisional application No. 60/993,832 filed on Sep. 14, 2007.

TECHNICAL FIELD OF THE INVENTION

The present invention relates to dispensing assemblies for dispensing plastic bags and, more particularly, to packs of plastic bags and racks for dispensing plastic bags. Still more particularly, the present invention relates to packs of plastic bags having sleeves enveloping the packs of plastic bags, packs of plastic bags having grab tabs and/or grab handles, racks with tongues for pushing forward the grab tabs and/or grab handles, and racks having generally flat, looped or spherical shaped members which make it easy to install packs of plastic bags onto the rack, yet make it quite difficult to remove packs of plastic bags once installed.

BACKGROUND OF THE INVENTION

In supermarkets, department stores, fast food restaurants, and other retail outlets, there is frequently the need for consumers or store employees to place items in bags to facilitate handling and purchase. For example, produce bags are dispensed directly to customers to allow the customer to bag the produce as it is chosen for purchase. Also, in deli or meat departments, store employees place the selected meats or other deli products in bags (or other packaging) for the consumer. At fast food restaurants, especially when an order is made "to go," the employee places the food in a plastic bag to facilitate handling and prevent spilling or leaking In the prior art, there are a number of designs for dispensing bags for these purposes.

Roll mounted produce bags are commonly found in modem grocery stores and supermarkets. These bags are designed for customers to use when purchasing fresh produce. The bags currently available are difficult for customers to use for several reasons. First, the bags tend to cling together due to excessive static and are difficult to separate from the roll. Second, it is difficult to tell the open end of the bag from the closed end of the bag. Third, the individual bags are difficult to open, as the sides tend to cling together. Fourth, some roll bags are "tn-folded" and require two hands to unfold and open fully.

Also, the prior art teaches plastic bag dispenser packs of produce bags or the like, wherein the bag packs are hung on, for example, plastic tab members. The pack of plastic bags includes a disposable upper portion connected to the lower plastic bag. A perforation is made between the upper portion and the lower plastic bag. The upper portion is attached to the plastic tab member. When a customer wants to use a plastic bag, he pulls on the lower plastic bag and tears it away from the upper portion at the perforation. These plastic bags suffer from many of the same shortcomings as plastic bags on rolls. Additionally, with these bag dispensing systems it frequently requires two hands to pull the bag down and open it Further, often more than one bag is removed, resulting in wasted bags.

U.S. Pat. No. 5,732,833, herein incorporated by reference, commonly owned by applicant, discloses a dispensing assembly for supporting packs of plastic bags. The packs of plastic bags include a disposable upper portion connected to the lower bag portion. A perforation is made between the disposable upper portion and the lower bag portion. When a customer wants to use a plastic bag, he pulls on the lower bag portion and tears it away from the disposable upper portion at the perforation While these plastic bags are suitable and cost-effective for a number of situations, in other situations these plastic bags suffer from some shortcomings. For example, with these bag dispensing systems it frequently requires two hands to pull the bag down and open it Also, often more than one bag is removed, resulting in wasted bags.

U.S. Pat. No. 6,264,059 commonly owned by applicant, discloses a "bag shield" for facilitating the removal of only one bag at a time from the stack and for maintaining a "billboard effect" of the bags in the stack This product has not been commercially successful for two reasons: (1) The bag shield must be removed to add additional packs of plastic bags to the rack and then the bag shield must be placed back on the rack over the additional packs of plastic bags. The present invention avoids the shortcomings. (2) In a grocery store or other retail store, the space a product occupies is an important consideration. The billboard effect of the '059 Patent requires a larger "footprint" (i.e., it is less desirable than the product(s) of the present invention because it takes up more space).

U.S. Patent Application Publication No. 2006/0102573, herein incorporated by reference, commonly owned by applicant, discloses a four sided rack for holding four different sizes of packs of plastic bags.

U.S. Patent Applications Publication Nos. 2007/0144988 and 2007/0144989 both herein incorporated by reference, both commonly owned by applicant, disclose wire racks with wire side protectors for holding packs of plastic bags. U.S. Patent Application Publication No. 2007/0031069 discloses a pack of plastic bags having a pouch.

Plastic Bag Dispensing Systems

There are many types of plastic bag dispensing systems. For example, U.S. Pat. No. 5,732,833, commonly owned by applicant, discloses a dispensing assembly for supporting packs of plastic bags. The floor standing rack includes a base member, a vertical member, and a support hook for holding the packs of plastic bags. The packs of plastic bags include a disposable upper portion connected to the lower bag portion. A perforation is made between the disposable upper portion and the lower bag portion.

The present invention(s) are concerned with racks and packs of plastic bags, as opposed to rolls of plastic bags and the devices for holding the rolls.

Packs of Plastic Bags with Disposable Upper Portions

FIGS. 1 and 2 show packs of bags 20 wherein a number of individual bag units are joined together to form the pack 20. The individual bag units have a disposable upper portion 21 and a lower bag portion 22 with a serration 23 between the disposable upper portion 21 and the lower bag portion 22. In forming the pack 20, the individual bag units are stacked on top of each other, and a header 24 is placed about the disposable upper portion 21. The header 24 and the disposable upper portions 21 are joined together in any suitable way; preferably, the header 24 is joined to the disposable upper portions 21 by inserting heated blunt rods through the header 24 and the disposable upper portions 21 to melt the header 24 and the disposable upper portions 21 together about the points of insertion 25. The insertion of the heated blunt rods serve to melt the plastic immediately adjacent to the header 24 and the disposable upper portions 21 at the points of insertion 25 to join together the header 24 and the disposable upper portions 21 of the individual bag units. In FIGS. 1 and 2, the points of insertion 25 show that small circular heated blunt rods were used to melt the plastic in the header 24 and the disposable upper portions 21; however, any shape of blunt heated rods would be suitable for this purpose. The header 24 is formed by cutting a flat, generally rectangular plastic piece and folding the rectangular plastic piece longitudinally in half to substantially cover the disposable upper portions 21.

FIG. 1 shows one embodiment of the header 24 wherein tabs 26 are cut from the header 24 (prior to folding the header 24 in hail) and side holes 27 and center whole 28 are placed in the tabs 26. FIG. 2 shows another embodiment of the header 24 having side holes 29 and center hole 30. Here, the holes 29,30 may be cut out of the header 24 and the disposable upper portions 21, or the holes 29, 30 may be formed with the use of heated to blunt rods as discussed above and as is known in the art. Preferably, the side holes 27, 29 are designed to be 8 inches apart; however, 6 inches or any other suitable distance may be used. The side holes 27,29 are utilized when two support hooks are used; the center holes 28,30 are utilized when one support hook is used.

Alternatively, a pack of plastic bags 20 may be formed without a header 24. In this embodiment (not shown), the individual bag units are slacked on top of each other and the disposable upper portions 21 are joined together such as by inserting heated blunt rods through the disposable upper portions 21 to melt the disposable upper portions 21 together about the points of insertion. The holes for hanging on a rack may be cut out of the disposable upper portions 21 or formed with the use of heated blunt rods.

The individual bag units generally include a back sheet and a front sheet which are sealed around the sides and bottom to form the lower bag portions 22. The back sheet includes serration 23 and the disposable upper portions 21, while the front sheet terminates just below serration 23 to form a bag opening 31. The individual bag units formed with opening 31 allows a product to be placed in a bag while the bag remains attached to the pack of plastic bags 20 such that the user may then use two hands to remove the bag from the pack of plastic bags 20 and seal the bag. The back sheet of the bag is attached to the upper disposable section with the serrated line while the front sheet of the bag is not attached to the upper disposable section and remains open, although, in use, it is not readily visibly apparent that the front of the bag is open.)

Packs of Plastic Bags without Disposable Upper Portions

There are several types of packs of plastic bags which do not have the disposable upper portion. For example, "T-shirt" plastic bags have handles extending upwards. The handles are fused together (e.g., with hot pins, "pressure bullets," etc.) to hold the bags together in a pack When a T-shirt plastic bag is removed from its pack, there is no disposable upper portion.

The present invention(s) relate to packs of plastic bags with disposable upper portions and to packs of plastic bags without disposable upper portions.

Racks and Devices for Holding Plastic Bags

There are many types of racks for holding packs of plastic bags. Also, there are many devices for holding rolls of plastic bags. The present invention(s) only relate(s) to racks for holding packs of plastic bags.

As discussed above, U.S. Pat. No. 5,732,833, commonly owned by applicant, discloses a dispensing assembly for supporting packs of plastic bags. The floor standing rack includes a base member, a vertical member, and a support hook for holding the packs of plastic bags.

U.S. Patent Application Publication No. 2006/0102573, 10 commonly owned by applicant, provides a rack which is floor standing, stable, requires a minima! amount of space and is inexpensive to fabricate. It presents packs of different sized plastic bags in a neat and orderly, visually appealing manner. It is convenient to select the appropriate sized bag, and the rack is easy to stock with packs of plastic bags. An inventive feature of the invention is that the rack has four sets of hooks allowing the placement of four packs of different sized plastic bags in a neat and orderly manner such that the user may select which sized bag is appropriate for the product being placed in the bag. With known racks for holding packs of plastic bags, if different sized plastic bags were hung on the racks, the packs of plastic bags would be presented in a sloppy or haphazard manner. A rectangular platform having four sets of hooks provides a more visually appealing way to present four packs of different sized plastic bags than any other known way for presenting multiple packs of plastic bags. Here, it is preferable to hang wider packs of plastic bags on the wider sides of the rectangular platform. Also, preferably the platform rotates about the vertical member 13 allowing the user to more easily select the appropriate sized bag.

U.S. Patent Applications Publication Nos. 2007/0144988 and 2007/0144989, both herein incorporated by reference, both commonly owned by applicant, disclose wire racks with wire side protectors for holding packs of plastic bags.

Thus, there are a number of shortcomings with the known rolls of plastic bags and other bag dispensing systems. A common problem with dispensing produce bags is providing one bag to the consumer in a convenient, simple, and reliable fashion. Further considerations relate to ease of replenishing the supply, uniformity of dispensing, ease of opening, and ease of filling.

A need has arisen for a bag dispensing system which easily dispenses one (and only one) bag which can easily be opened and filled.

The present invention(s) relates to racks and packs of plastic bags which are used in grocery stores, retail stores, fast food restaurants, etc. to dispense plastic bags to hold the items purchased.

The present inventive product(s) is advantageous over known bag dispensing systems. It provides bag dispensing systems wherein the user is led to remove one bag instead of many bags from the system. Further, it provides bag dispensing systems for easy opening and filling of the bags.

The present invention(s) relate to all types of racks for holding packs of plastic bags, regardless of design or manufacturer.

These and other advantages of the present invention will become apparent from the following description and drawings.

SUMMARY OF THE INVENTION

A pack of bags with a sleeve that provides an envelope for the pack of bags is disclosed. The individual bag units have a disposable upper portion, a lower bag portion with a serration therebetween. The sleeve covers at least a portion of the two sides of the pack of plastic bags with front and back walls having openings. A header is placed about the top of the sleeve and the top portion of the bags. In the plurality of bag units in the pack of plastic bags, each front sheet and back sheet is cut to form a an opening and a grab tab 60 for each bag.

A tongue is disclosed that may be inserted in the opening to push forward the grab tab when the pack of plastic bags is suspended from a rack. The tongue may be located or affixed in a number of places, e.g., it may be attached to a hanging rack, in contact with a hanging rack, or in proximity to a hanging rack. Also, pack of plastic bags may have its own tongue attached to its header. Further, each pack of plastic bags may have a back sheet (not a bag), and the tongue may be attached to the back sheet (not shown).

A tongue is provided and designed to push forward substantially all of the grab tabs in a pack of plastic bags supported on a rack and to generally extend the grab tab forward of each bag.

Packs of plastic bags with or without grab tags and with or without sleeves may be suspended from a variety of racks. If tabs are used requiring tongues for pushing the tags, tongues of various configurations are provided to effect the same.

A spinner rack is disclosed having a spinner top with hooks having flat heads and stops, a removable tongue and a support pole. The tongue and the spinner top are intimately received over the pole and are allowed to rotate as one piece with packs of plastic bags suspended therefrom.

Further, a rack constructed of wire material and supported by a floor stand is disclosed. A removable tongue is attached to the floor stand too push the grab tags. The rack is further secured to the floor stand by a locking mechanism. Another rack with a removable tongue and various embodiments of the removable tongues are also disclosed.

BRIEF DESCRIPTION OF THE DRAWINGS

For a detailed description of the preferred embodiment of the invention, reference will now be made to the accompanying drawings wherein.

DETAILED DESCRIPTION OF THE PREFERRED EMBODIMENTS

Figure 1:
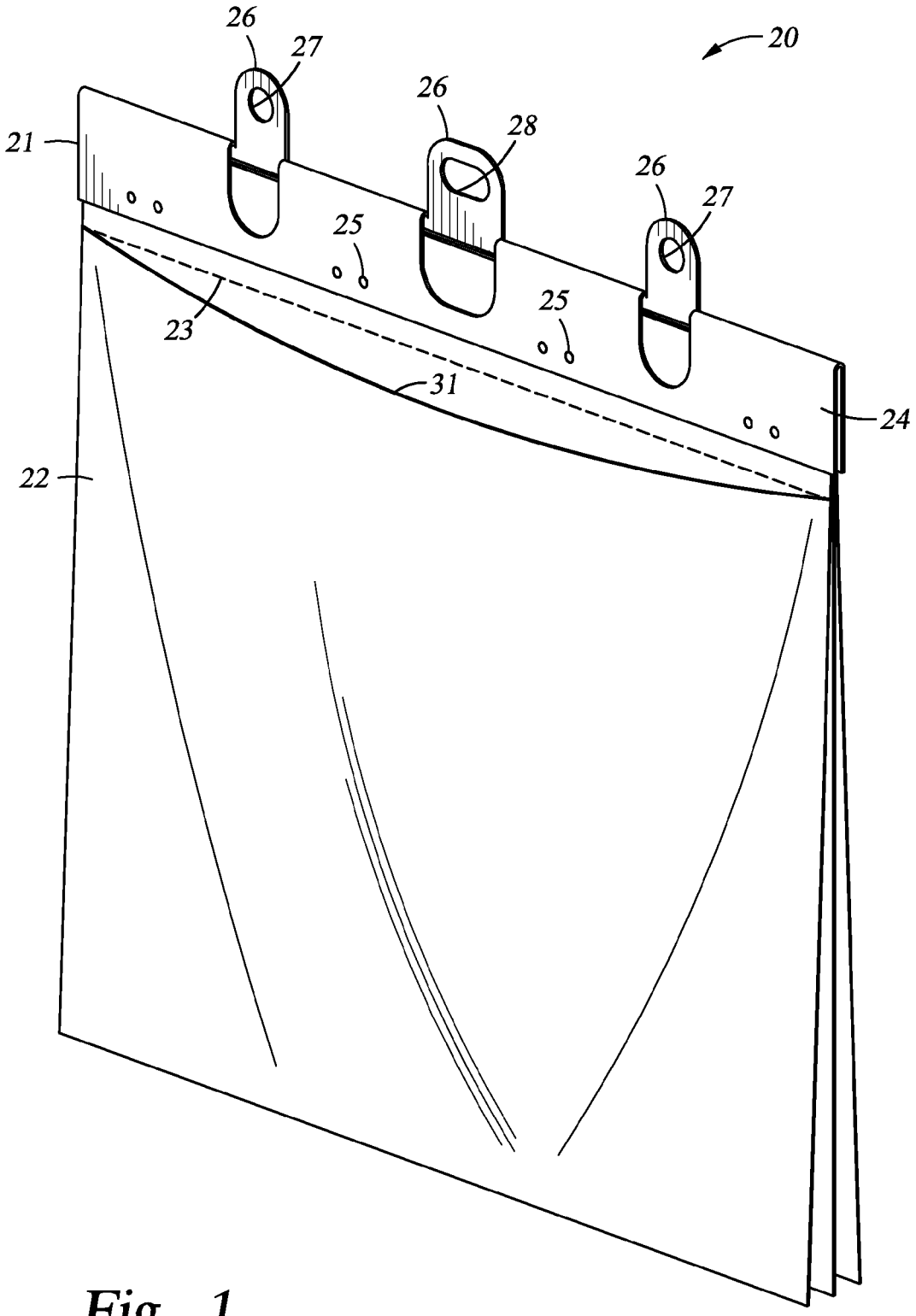
Fig. 1 (PRIOR ART)
FIG. 1 is a rear perspective view of a pack of plastic bags which is prior art.
Figure 2:
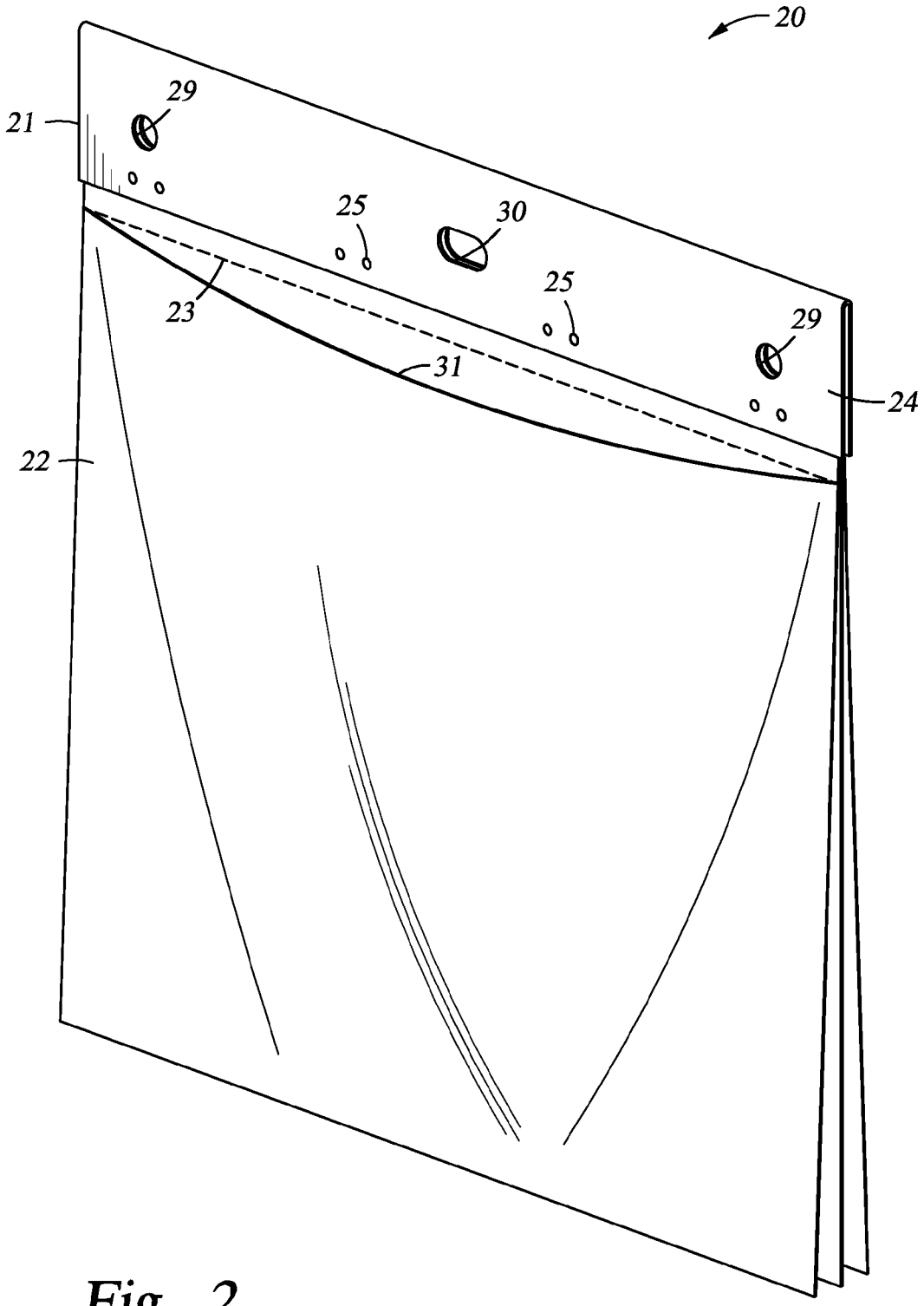
Fig. 2 (PRIOR ART)
FIG. 2 is a front perspective view of the pack of plastic bags of FIG. 1 which is prior art.
Figure 3:
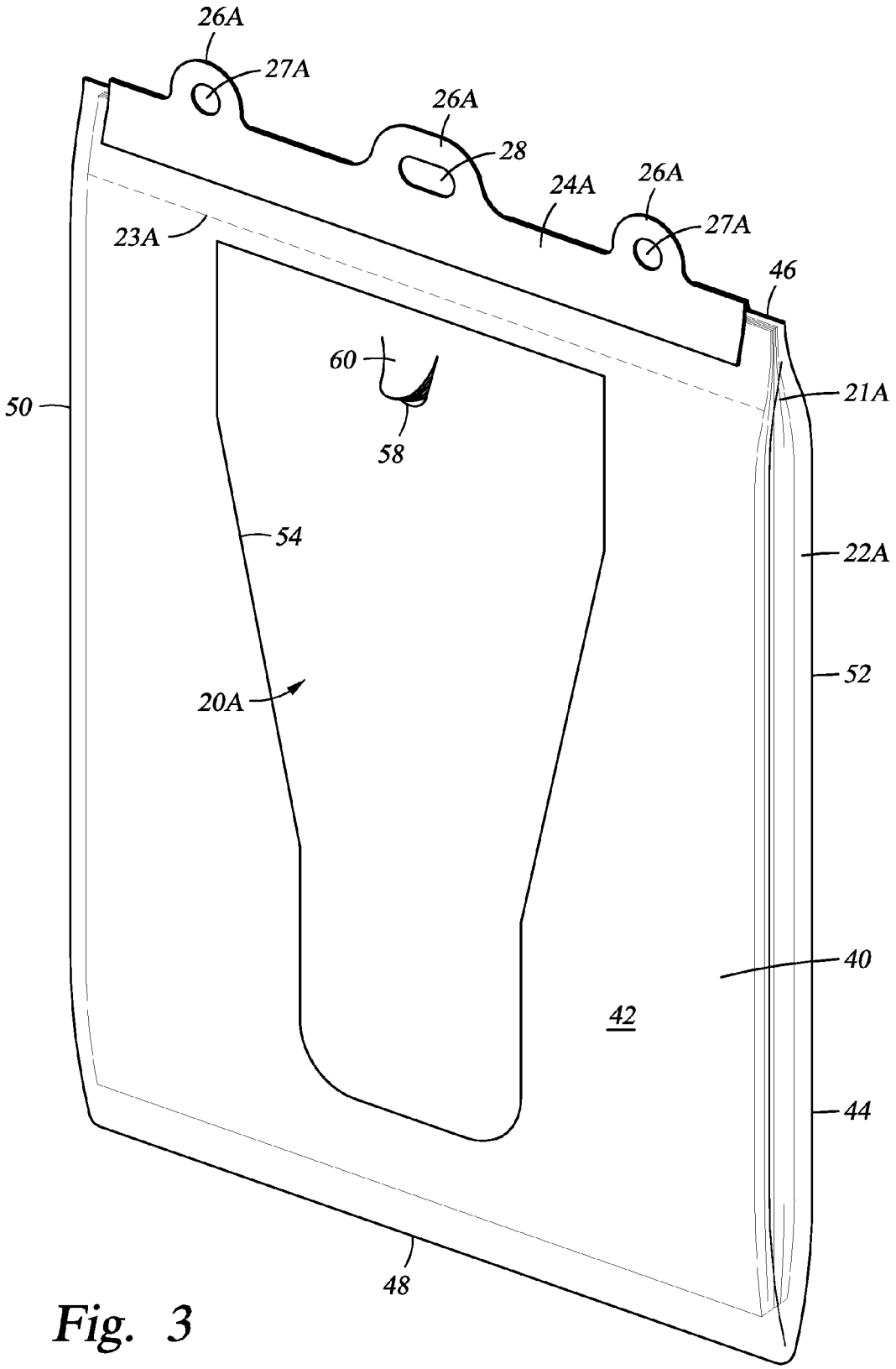
FIG. 3 is a front perspective view of a pack of plastic bags with a sleeve and tabs in accordance with the present invention.

Referring now to FIG. 3, there is shown a pack of bags 20A constructed like the previously described pack of bags 20. The individual bag units have a disposable upper portion 21A and a lower bag portion 22A with a serration 23A between disposable upper portion 21A and lower bag portion 22A.

A sleeve 40 made of plastic material envelops pack of bags 20A and covers at least a portion of the two sides of pack of plastic bags 20A. Sleeve 40 is preferably made of plastic material and is thicker and stronger than that of the bags. It can have different color or a substantially different appearance than the bags. Sleeve 40 has a front wall 42 and a back wall 44 connected to each other along top 46, bottom 48 and sides 50 and 52. A header 24A which is similar to header 24 that was previously described is placed about top 46 and disposable upper portion 21A and is joined therewith, as previously described in connection with the joining between header 24 and upper portion 21. Like header 24, header 24A has three tabs 26A with a center hole 28 A and side holes 27A. Pack of bags 20A may be suspended from a rack by inserting appropriate hooks in one or more of center hole 28A and side holes 27 A.

Figure 4:
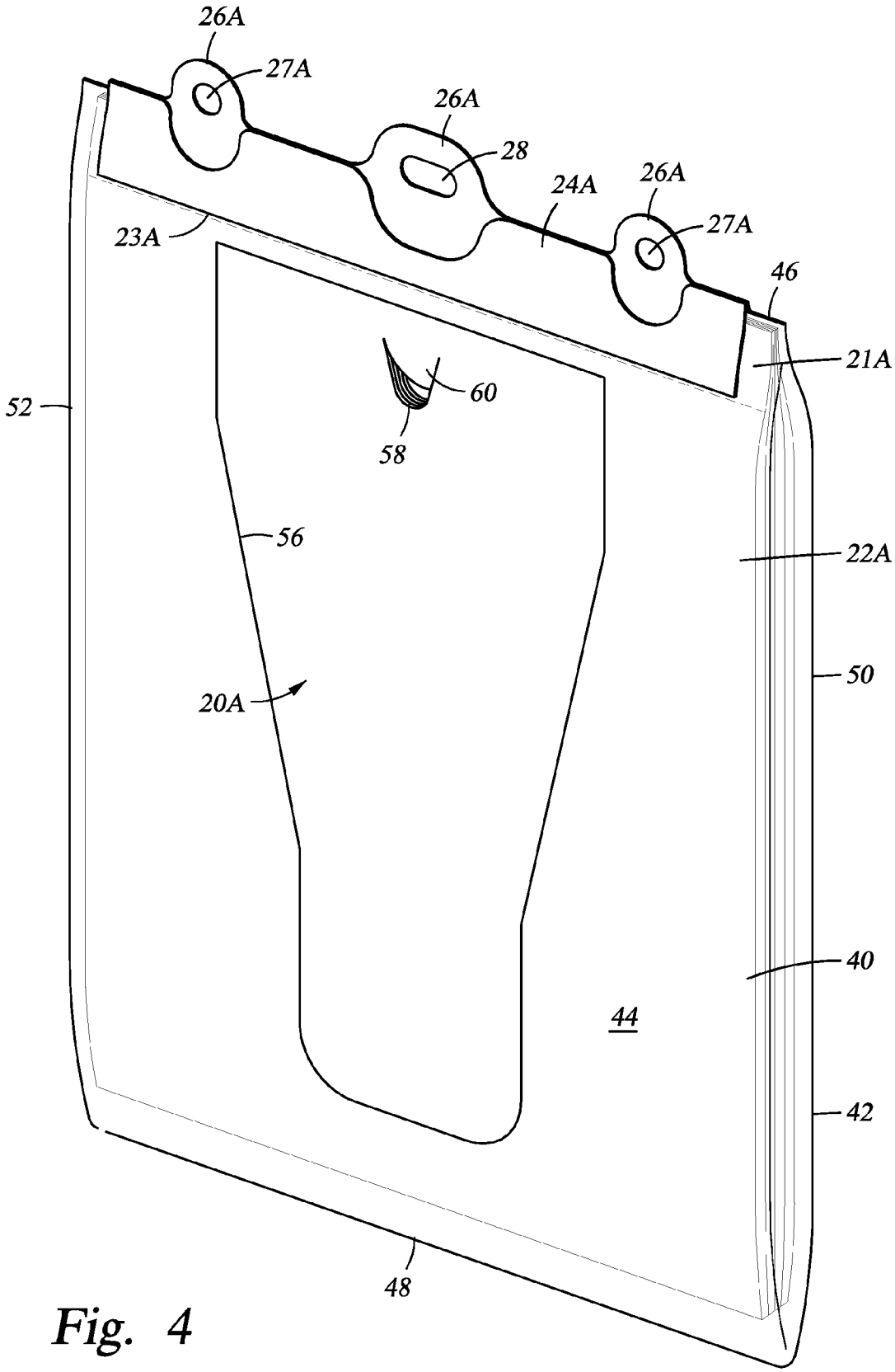
FIG. 4 is a rear perspective view of the pack of plastic bags of FIG. 3 in accordance with the present invention.

The center portion of front wall 42 has an opening 54 and the center portion of back wall 44 has an opening 56 (not shown in FIG. 3 but shown in FIG. 4).

As shown in FIG. 3, sleeve 40 covers at least a portion of the two sides of pack of plastic bags 20A. Sleeve 40 prevents persons from grabbing several bags from the side of pack of plastic bags 20A when only one bag is needed. If sleeve 40 were not present, several plastic bags could have been torn from pack of plastic bags 20A, resulting in the waste of several bags. In most cases, several packs of plastic bags 20A are stacked together on a rack (not shown). As noted, the center portion of both front wall 42 and back wall 44 of pack of plastic bags 20A is open via opening 54 and opening 56 (not shown in FIG. 3 but shown in FIG. 4), respectively. This provides that, once all the plastic bags have been removed from the front pack of plastic bags, the person can reach through and remove plastic bags from the second pack of plastic bags, and so forth, without any need for removing the empty packs of plastic bags. Sleeve 40 both reduces waste and reduces the store manpower required to reload the rack to provide plastic bags to customers.

Still referring to FIG. 3, in the plurality of bag units in pack of plastic bags 20A, each front sheet and back sheet is cut to form a an opening 58 and a grab tab 60 for each bag. A tongue (not shown in FIG. 3), may be inserted through opening 58 to push forward grab tab 60 so that a person can grab it easily. The tongue may be located or affixed in a number of places, e.g., it may be attached to a hanging rack, in contact with a hanging rack, or in proximity to a hanging rack. Also, pack of plastic bags 20A may have its own tongue attached to its header (not shown). Further, each pack of plastic bags may have a back sheet (not a bag), and the tongue may be attached to the back sheet (not shown). The tongue is provided and designed to push forward substantially all of grab tabs 60 in pack of plastic bags 20A supported on a rack and to generally extend grab tab 60 forward of each bag. It is so designed so that a user can easily grab tab 60, and pull and remove one bag (and only one bag) from pack of plastic bags 20A.

Referring now to FIG. 4, there is shown the back of packs of plastic bags 20A. The individual bag units have upper portion 21A and lower bag portion 22A with serration 23A between upper portion 21A and lower bag portion 22A.

Sleeve 40 having front wall 42 and back wall 44 connected along top 46, bottom 48 and sides 50 and 52 envelopes pack of bags 20A. This center portion of back wall 44 has an opening 56 which allows a person to retrieve a bag from a second pack of plastic bags once all the bags are removed from the front pack of plastic bags, and so forth, without the need for removing the empty packs of plastic bags.

Still referring to FIG. 4, there is shown opening 58 and grab crab 60 extending forward and away from that back wall 44 to facilitate the removal of a bag, as previously described. Header 24A having tabs 26A with center holes 28A and side holes 27A is disposed over top 46 of sleeve 40 and upper portion 21A.

Figure 5:
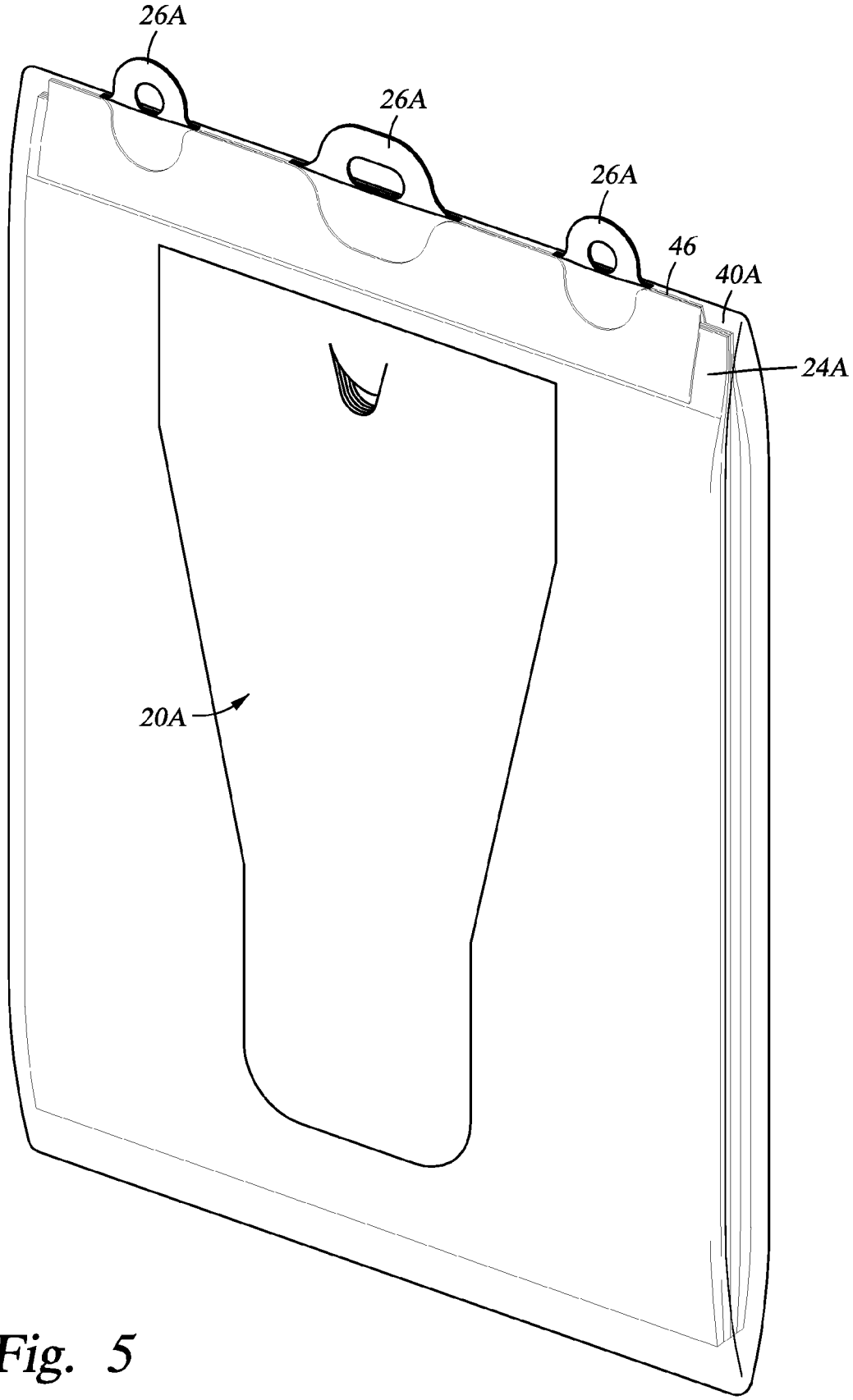
FIG. 5 is a rear perspective view of a pack of plastic bags with a sleeve disposed over the header of the pack of bags and tabs in accordance with the present invention.

Referring now to FIG. 5 there is shown an alternative embodiment of the present invention wherein a sleeve 40A envelopes pack of bags 20A like sleeve 40 envelopes pack of bags 20A in FIGS. 3 and 4, except that in the embodiment shown in FIG. 5, sleeve 40A is disposed over and envelopes header 24A (other than tabs 26A) with top 46 being over header 24A. In the embodiment shown in FIGS. 3 and 4, header 24A is over top 46 and the top portion of sleeve 40.

Figure 6:
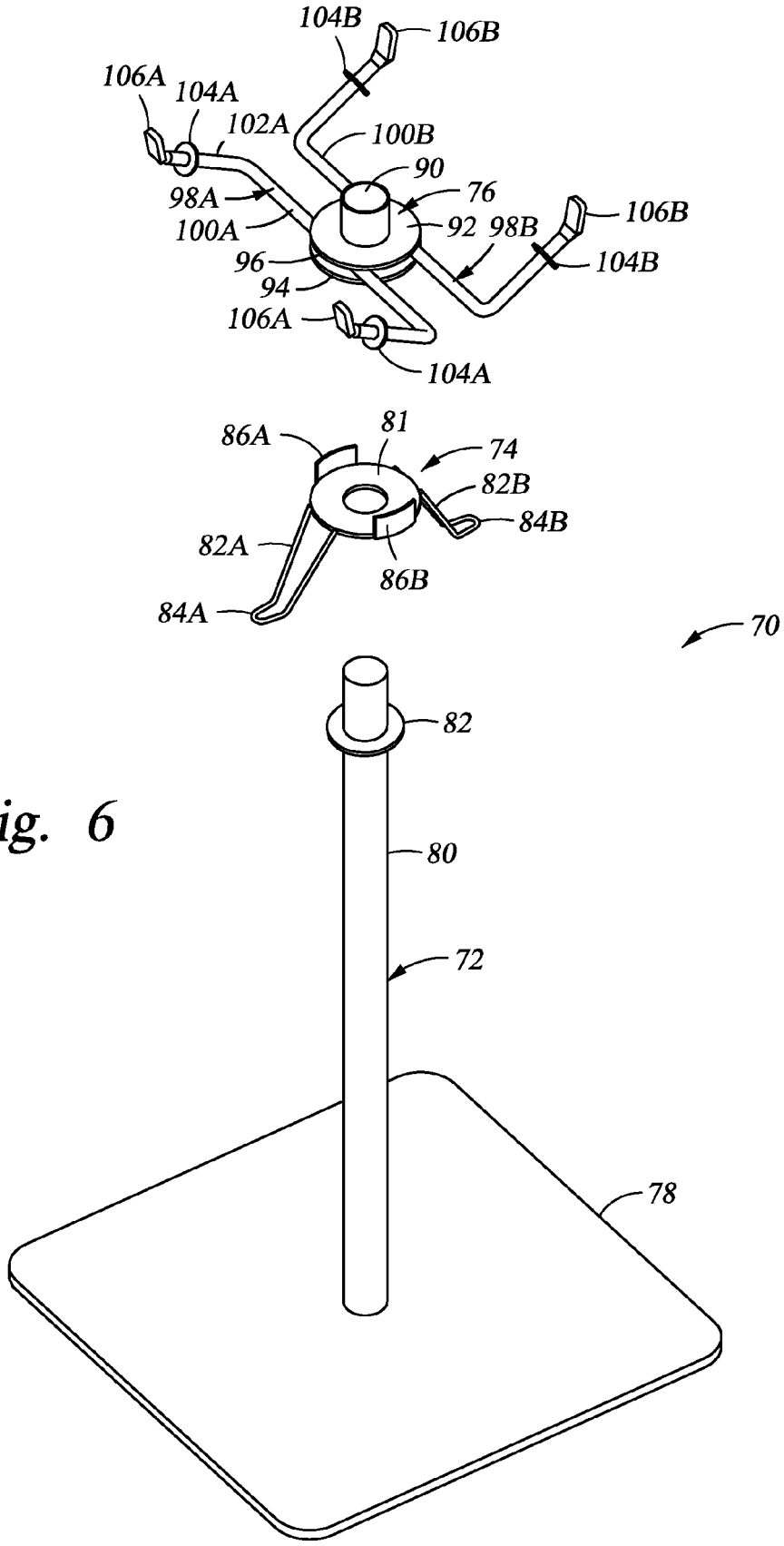
FIG. 6 is an exploded perspective view of a rack in accordance with the present invention.

Referring now to FIG. 6, there is shown an unassembled spinner rack 70 having a floor stands 72, a tongue element 74 and a spinner top 76. Floor stands 72 includes a base 78 that supports an elongate, vertical cylindrical pole 80 extending therefrom and a horizontal circular flange 82 extending from the exterior of pole 80 near the upper end thereof.

Tongue element 74 includes a flat ring 81 having an inside diameter which is appropriately sized to be intimately received over the cylindrical surface of pole 80. Tongue element 74 further includes tongues 82A and 82B which are symmetrical with respect to each other. Tongues 82A and 82B are connected to the exterior of ring 81 and extend downwardly and outwardly from ring 81. Tongues 82A and 82B have lower ends which are at an angle with the remaining portion of the tongue to form an outwardly, generally horizontal lips 84A and 84B of tongues 82A and 82B, respectively.

Tongues 82A and 82B are constructed by forming a loop with wired material to make the shape shown in FIG. 6. Tongues may also be constructed of solid metal material appropriately shaped and formed to form a tongue that can push the grab tabs for easy removal of the bags.

Tongue element 74 further includes arched flanges 86A and 86B which are symmetrical with respect to each other extending upwards from ring 81.

Spinner top 76 includes an inner cylindrical member 90, circular flanges 94 and 96 extending from the exterior of cylindrical member 90 and forming a circular groove 96 therebetween. Spinner top 76 further includes hook elements 98A and 98B which are symmetrical with respect to each other. Hook elements 98A is formed by bending the end portions of an elongate rod 100A to form a pair of hooks 102A. Each of hooks 102A are symmetrical with respect to each other. Each of hooks 102A includes a stop 104A and a generally flat head 106A. The middle portion of rod 100A is tangentially received in groove 96 and is securely attached to cylindrical member 90.

Similarity, hook elements 98A is formed by bending the end portions of an elongate rod 100B to form a pair of hooks 102B. Each of hooks 102B are symmetrical with respect to each other. Each of hooks 102B includes a stop 104B and a generally flat head 106B. The middle portion of rod 100B is tangentially received in groove 96 and is securely attached to cylindrical member 90.

Figure 7:
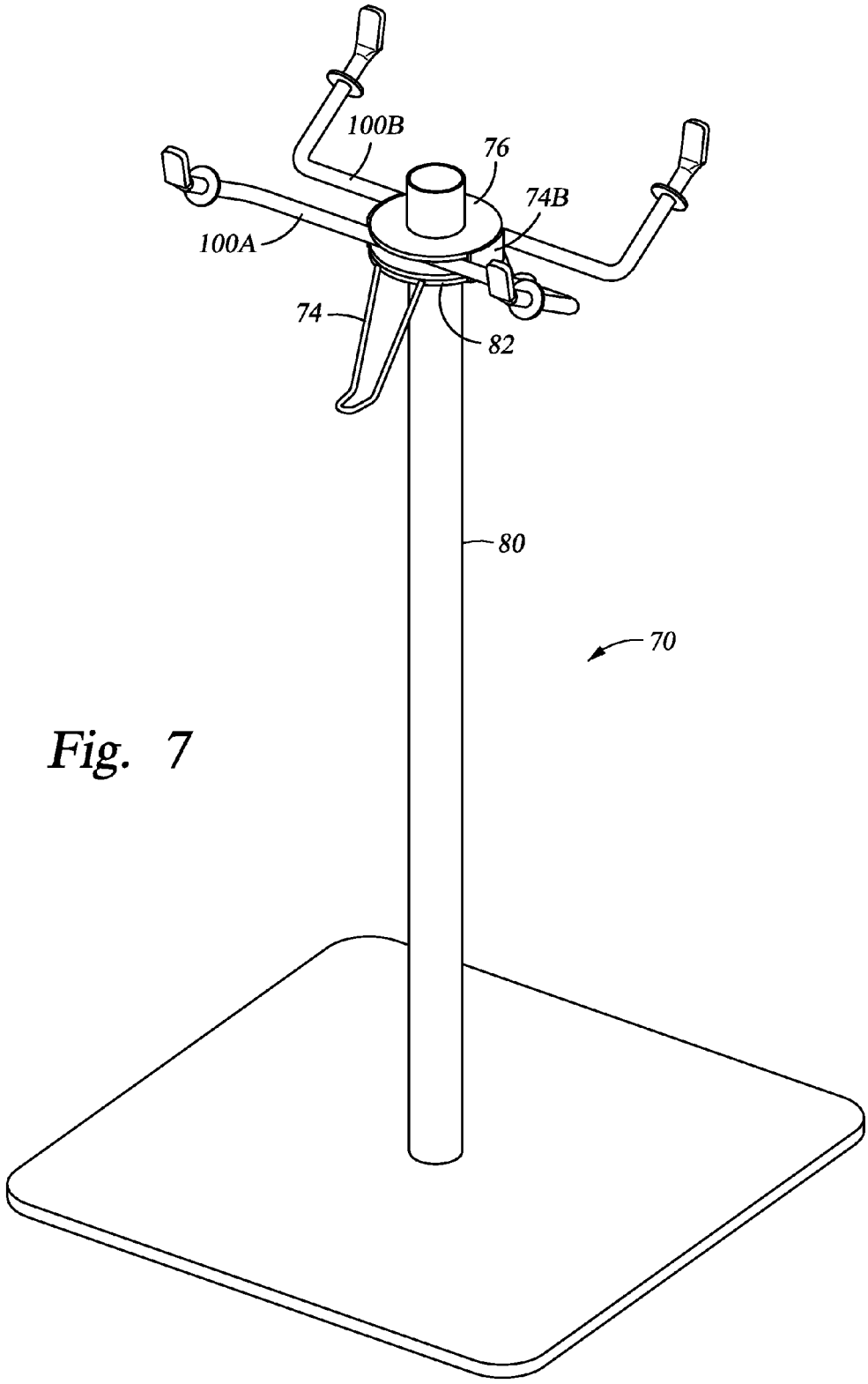
FIG. 7 is a perspective view of the rack of FIG. 6 in an assembled mode in accordance with the present invention.

Referring now to FIG. 7, there is shown spinner rack 70 of FIG. 6 in an assembled position. Tongue element 74 is intimately received over the upper portion of pole 80 and rests on flange 82. Spinner top 76 is also intimately received over the upper portion of pole 80 and rests on flat ring 81 of tongue element 74. Arched flange 74B and arched flange 74A (not shown in FIG. 7) are intimately inserted in the space formed between rods 100A and 100B so that tongue element 74 and spinner top 76 can rotate together as one piece around pole 80.

Figure 8:
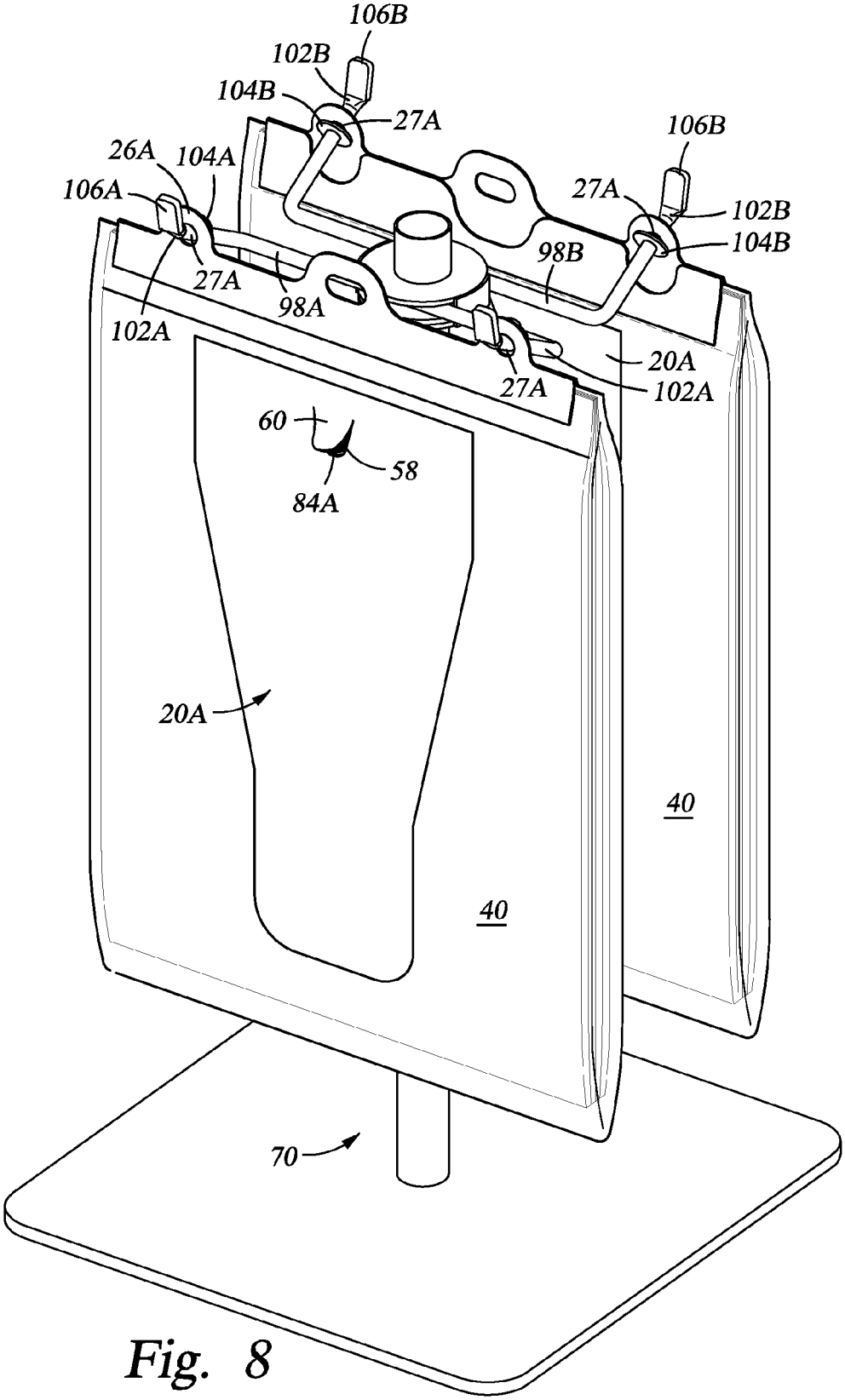
FIG. 8 is a perspective view of the rack of FIG. 7 having packs of plastic bags of FIG. 4 suspended therefrom in accordance with the present invention.

Referring now to FIG. 8, there is shown spinner rack 74 of FIGS. 6 and 7 having suspended therefrom packs of plastic bags 20A with sleeves 40 enveloping them. More particularly, pack of plastic bags 20A, enveloped by sleeve 40, is suspended from hook element 98A by inserting heads 106A of hooks 102A in openings 27A. Stops 104A provide a stop for tabs 26A. Heads 106A which are appropriately sized to be inserted in openings 27A prevent the easy removal of pack of plastic bags 20A. Lip 84A extends through opening 58 to push out tab 60 and make it easy to grab.

Pack of plastic bags 20A, enveloped by sleeve 40, is suspended from hook element 98B by inserting heads 106B of hooks 102B in openings 27A. Stops 104B provide a stop for tabs 26A. Heads 106B which are appropriately sized and configured to be inserted in openings 27A prevent the easy removal of pack of plastic bags 20A from hook element 98B.

Spinner top 76 and tongue element 74 can be rotated as one piece around pole 80 to make the bags more accessible to the user.

Figure 9:
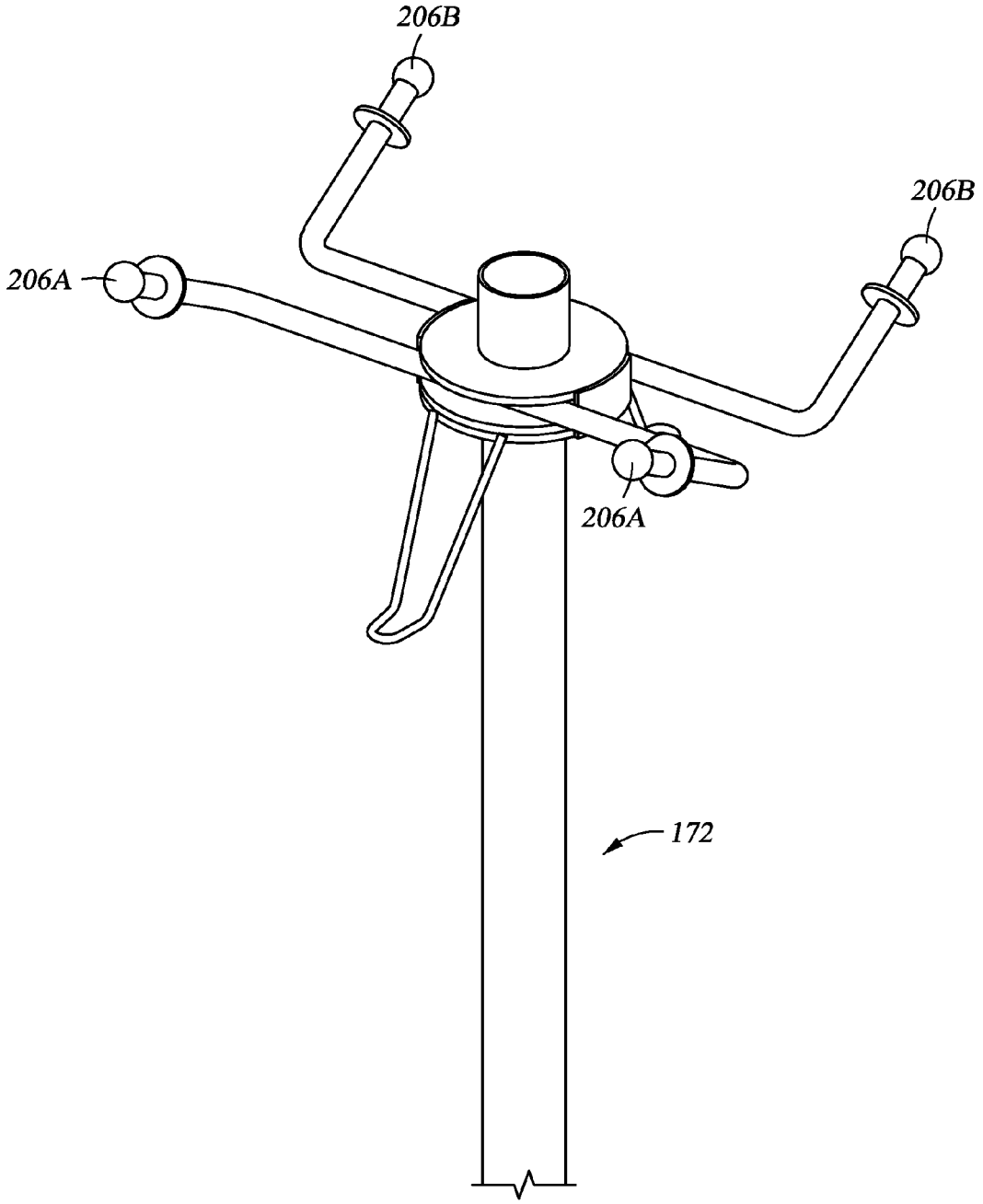
FIG. 9 is a perspective view of an alternative embodiment of the rack of FIG. 7 with spherical heads.

Referring now to FIG. 9, there is shown a spinner rack 172 which is the same as spinner rack 72 except that flat heads 106A and 106B of spinner rack 72 are replaced with spherical heads 206A and 206B. All the other parts of spinner rack 172 are the same as the corresponding parts of spinner rack 72.

Figure 10:
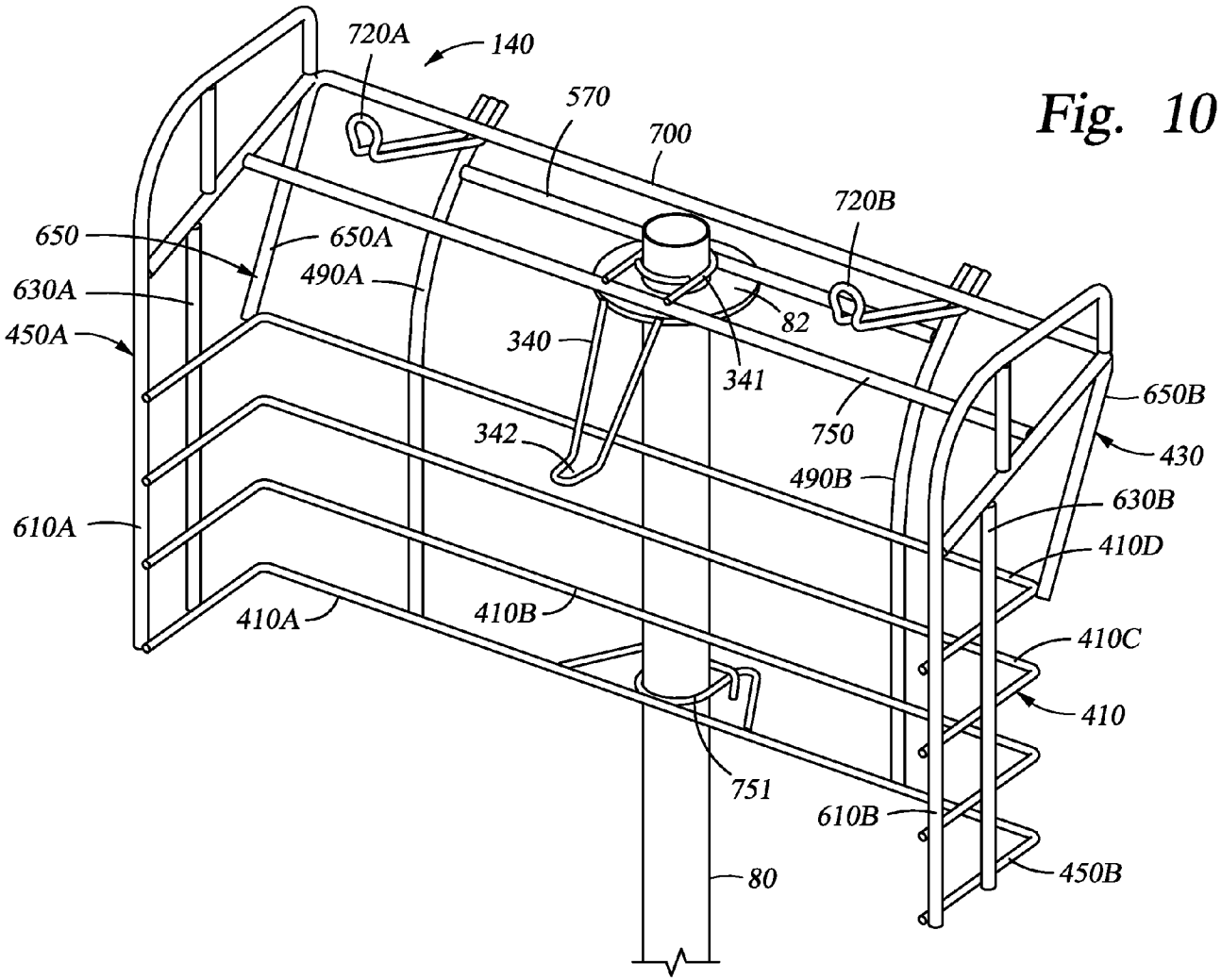
FIG. 10 is a perspective view of the rack and a tongue connected to support pole in accordance with the present invention.

Referring now to FIG. 10, there is shown a rack 140 being supported by floor stand 72 and having a tongue 340 for pushing out grab tags in accordance with the present invention. Stand 72 is similar to the one previously described and includes cylindrical pole 80 and circular flange 82 near its upper.

Rack 140 is generally similar to the rack described in U.S. Patent Application Publication Number 2007/0144989 with some modifications and improvements, to add tongue 340 and to improve the structural integrity of rack 140 and its ability to remain unaffected by any increased weight or pressure applied thereon. U.S. Patent Application Publication Number 2007/0144989 is incorporated herein by reference in its entirety.

Referring now to FIG. 10, rack 140 has a lower back support 410, an upper back support 430 and side protectors 450A and 450B which are symmetrical to each other. Lower back support consists of four horizontal wires 410A, 410B, 410C and 410D which are held in place by a back support wires 490A and 490B. Back support wires 490A and 490B are affixed by welding or similar means to wire 410A near side protector 450A. Back support wires 490A and 490B extend upwards Back support wires 490A and 490B are also affixed by welding or similar means to wires 410B, 410C and 410D to keep them in place and to form a sturdy back support. The upper sections of back support wires 490A and 490B extending above the point of connection with wire 410D and leading to a top back rail 700 are bend backwards to form an angle with the plane of lower back support 410. Horizontal rail 570 which is below top back rail 700 extends from back support wire 490A to back support wire 490B to strengthen upper back support 430.

A back support rail 650 extends upwards from wire 410D to form a back support rail portion 650A, then is bend horizontally to form top back rail 700, then downwards to form a back support rail portion 650B which is symmetrical to back support rail portion 650A and ends at a point where it is affixed to wire 410D. Back support rail 650 is at an angle with the plane of lower back support 410. Top back rail 700 is supported by upper sections of back support wires 490A and 490B which are securely affixed thereto by welding or similar means.

Side protectors 450A and 450B are formed by bending, at right angles, wires 410A, 410B, 410C and 410D on both ends thereof. A front rail 610A is affixed to one end of wire 410A and extends upwards to be affixed to the ends of wires 410B, 410C and 410D and to continue upwards where, at a certain elevation, it is bend backwards to form a horizontal portion that ends to top back rail 700 where it is securely connected by welding or similar means. A front rail 610B which is symmetrical to front rail 610A is affixed to the second end of wire 410A and extends upwards to be affixed to the ends of wires 410B, 410C and 410D and to continue upwards where it is bend backwards to form a horizontal portion that ends to top back rail 700 where it is securely connected thereto. Side protectors 450A and 450B further include side rails 630A and 630B which are symmetrical to each other and which extend vertically from wire 410A to the upper section rails.

Still referring to FIG. 10, hooks 720A and 720B are connected by welding or similar means to back support wires 490A and 490B. Hooks 720A and 720B are constructed from a wire bend to form a loop as shown in FIG. 10. Hooks 720A and 720B can also be constructed in any other manner described in applicant's other related patents and patent applications which are incorporated herein.

Tongue 340 has an upper ring portion 341 so that it can be intimately received over the upper portion of pole 80 and to rest on and be supported by flange 82. Tongue 340 further has an upper plate extending upwards and backwards from upper ring portion 341 so that it can provide support for the bags when one pushes on the bags in the are near the tongue when the bags are suspended as described herein from the rack Tongue 340 has a lower lip 342 which of a sufficient length to penetrate openings in the bags and push forward the grab tabs to facilitate the grabbing thereof by the user. Tongue 340 may be constructed by bending a wire or a flat metal or other means and manner.

Rack 140 further includes an upper horizontal wire 750 extending from side protector 450A to side protector 450B and which is parallel to and at the same elevation with horizontal rail 570. Horizontal rail 570 and horizontal wire are intimately received over pole 80 and rest on flange 82 when rack 140 is connected to pole 80. Further, rack 140 includes a lower circular hook 751 which hooks around pole 80 to lock and secure rack 140 thereon.

Figure 11:
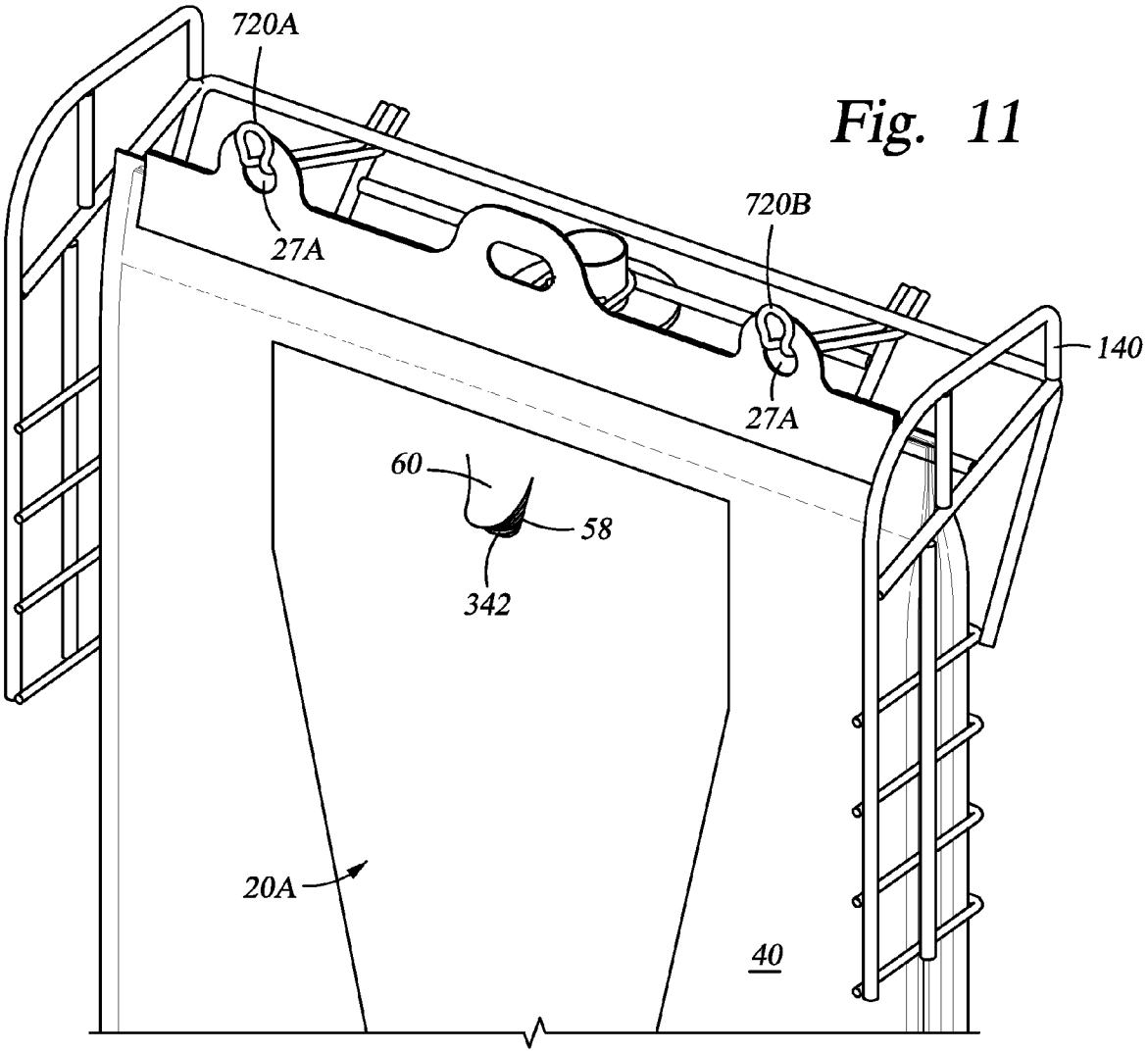
FIG. 11 is a perspective view of the rack of FIG. 10 having a pack of plastic bags of FIG. 4 suspended therefrom in accordance with the present invention.

Referring now to FIG. 11, there is shown rack 140 of FIG. 10 having suspended therefrom pack of plastic bags 20A with sleeve 40 enveloping it. More particularly, pack of plastic bags 20A, enveloped by sleeve 40, is suspended from hooks 720A and 720B by inserting them in openings 27A. Lip 342 extends through opening 58 to push out tab 60 and make it easy to grab.

Figure 12:
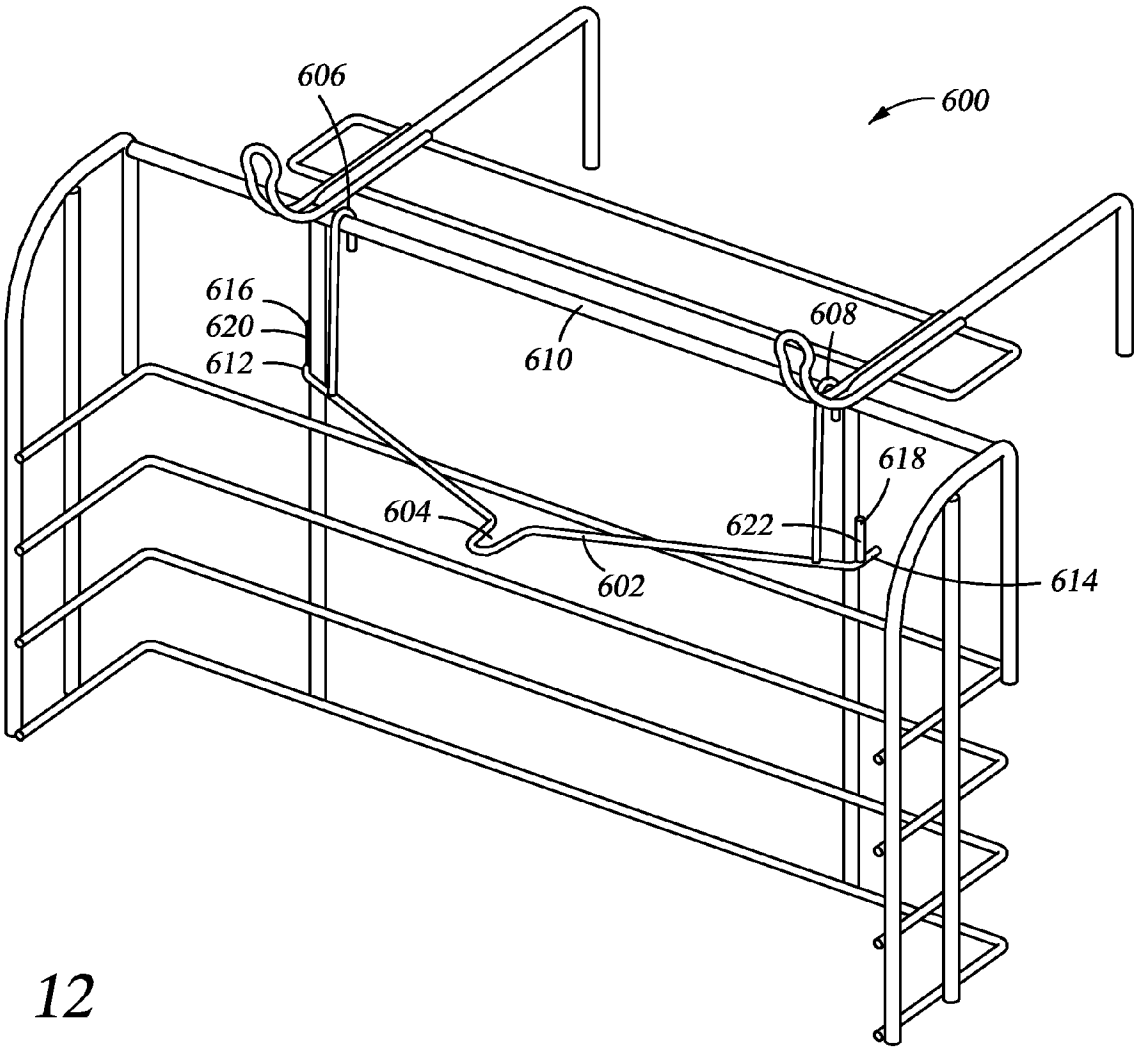
FIG. 12 is a perspective view of the rack and a removable tongue connected to the rack in accordance with the present invention.

Referring now to FIG. 12 there is shown a rack 600 similar to racks previously described in applicants' applications referred to above and which are incorporated herein by reference. A removable tongue 602 is configured to be removably attached to rack 600. It includes a lip 604, and downward loop ends 606 and 608 to engage a horizontal rail 610 in rack 600. Tongue 602 further includes lower ends 612 and 614 which engage vertical wires 616 and 618 in rack 600 for a stable connection therewith. The connection is further stabilized by providing stops 620 and 622 on wires 616 and 618, respectively, that prevent the upward movement of tongue 602 when it is engaged with rack 600. Tongue 602 can be used as previously described to facilitate the grabbing of the grab tags. They can be removed when in use with bags that do not have the grab tags previously described.

Figure 13:
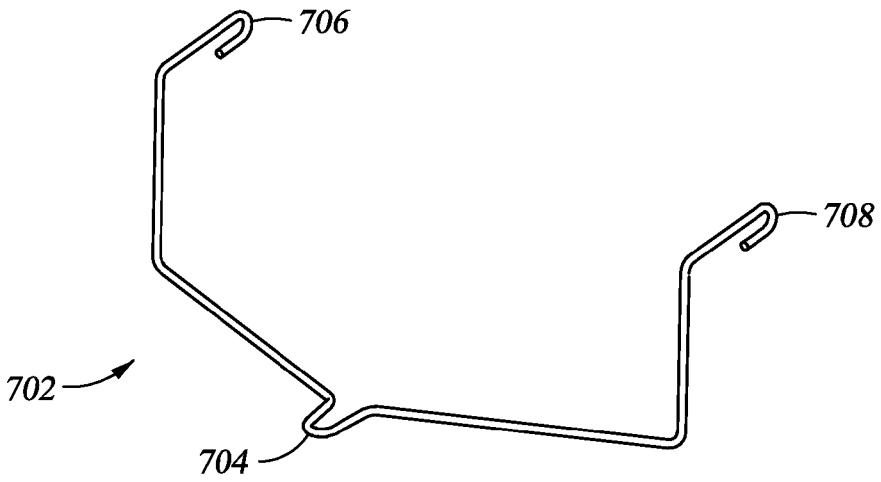
FIG. 13 is an alternative embodiment of the tongue shown in FIG. 12 in accordance with the present invention.
Figure 14:
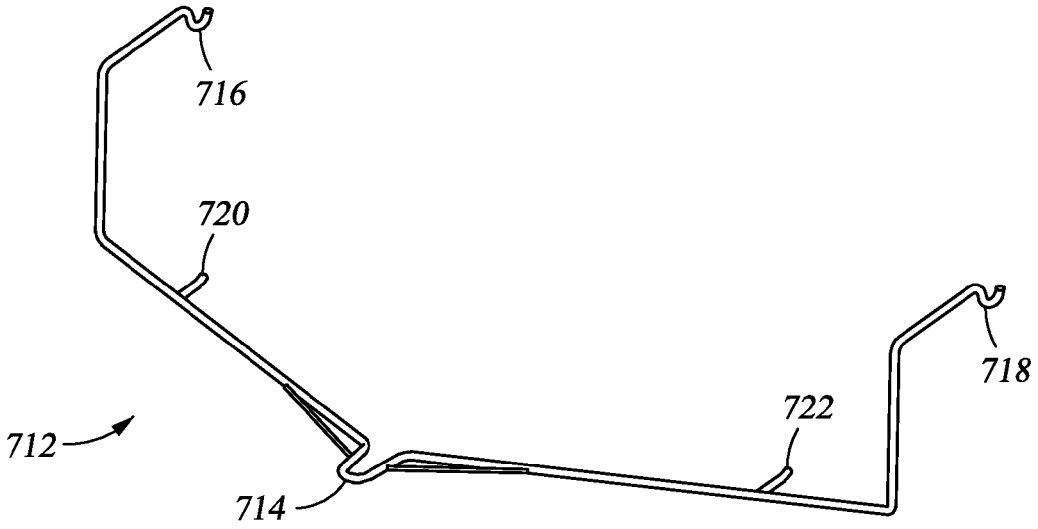
FIG. 14 is an alternative embodiment of the tongue shown in FIG. 12 in accordance with the present invention.

Referring now to FIGS. 13 and 14, there are shown alternative embodiment of removable tongues to be used in connection with racks. FIG. 13 shows a tongue 702 having a lip 704 and end hooks 706 and 708 for engaging a horizontal rail in a rack. FIG. 14 shows a tongue 712 having lip 714 and upwardly facing end hooks 716 and 718 for engaging a horizontal rail in a rack. Tongue 712 further includes extensions 720 and 722 for engaging vertical wires in a rack to stabilize the connection.

In addition to the grab tags described above which utilize the tongues, the present invention discloses a grab tab, located near the top of each plastic bag, generally extending forward of each bag, which is designed such that a user can easily grab the grab tab, pull, and one bag (and only one bag) is removed from the pack of plastic bags. The grab tab serves two purposes: (1) to reduce waste by the removal of just one bag, and (2) to make it easier for a user to remove a plastic bag from the pack of plastic bags.

Grab tabs, without corresponding tongues, may be an additional piece of plastic attached to the front sheet of each plastic bag or may be a configuration of the front sheet designed as a grab tab.

In an alternative embodiment, a grab handle is disclosed. The grab handle, located near the top of each plastic bag, generally extending forward of each bag, which is designed such that a user can easily grab the grab handle, pull, and one bag (and only one bag) is removed from the pack of plastic bags. The grab handle serves three purposes: (1) to reduce waste by the removal of just one bag; (2) to make it easier for a user to remove a plastic bag from the pack of plastic bags; and (3) to provide a handle for easier carrying of the plastic bag.

Generally, but not always, a grab handle is larger than a grab tab and located lower on the plastic bag. These features allow the grab handle to support the weight of the products in the plastic bag.

Grab tabs and/or grab handles (without corresponding tongues) may comprises a grab tab and/or grab handle, wherein, for the plurality of bag units in a pack of plastic bags, each front sheet and back sheet is cut to form a grab tab and/or grab handle. The grab tab and/or grab handle may be extended forward of the front sheet (without pushing by a tongue) by a number of processes known by those of skill in the art, including, e.g., heat treatment in the area of the grab tab and/or grab handle, stamping, a different plastic or chemical composition in the area of the grab tab and/or grab handle, chemical treatment in the area of the grab tab and/or grab handle, or a combination thereof. Also, mechanical means, other than a tongue, may be used to extend the grab tab or grab handle forward of the front sheet of the plastic bag, e.g., the pack of plastic bags may be bent or folded such that the grab tab or grab handle extends forward of the front sheet. Further, friction between the cut grab tab and/or grab handle and the uncut sections of the plastic bags may hold the grab tab and/or grab handle forward of the plastic bag.

Another embodiment comprises a grab handle, wherein, for the plurality of bag units in a pack of plastic bags, each front sheet and back sheet is cut to form a grab handle. A tongue, which may be located or affixed in a number of places, e.g., it may be attached to the rack, in contact with the rack, or in proximity to the rack. Also, each pack of plastic bags may have its own tongue attached to its header (not shown). Further, each pack of plastic bags may have a back sheet (not a bag), and the tongue may be attached to the back sheet (not shown). The tongue is provided and designed to push substantially all of the grab handles in the packs of plastic bags supported on a rack forward, generally extending the grab handle forward of each bag; which is designed such that a user can easily grab the grab handle, pull, and one bag (and only one bag) is removed from the pack of plastic bags. The grab handle may be similar to the grab tab; however, the grab handle has the substantial additional advantage of being used as a handle. If a grab tab were used as a handle, many times, the weight of product in the plastic bag would tear the grab tab, resulting in a dropped plastic bag. As with other racks noted above, a tongue, attached to the rack, in contact with the rack, or in proximity to the rack, to push forward a grab tab or grab handle may be used.

The racks and tongues referred to herein may be constructed of any suitable material including heavy gauge wire, plastic, plastic covered wire, stainless steel, acrylic, wood, etc. Additionally, different parts of the racks may be constructed of different materials. The grab tags can be of different colors.

The material used to create the plastic bags and/or sleeves may be any suitable plastic resin, including low density polyethylene; linear low density polyethylene; high density polyethylene; high molecular weight, high density polyethylene; and polypropylene. Also, the material used to create the bags and/or sleeves may be a single extruded layer or a plastic film comprising multiple, co extruded layers.

All patents and publications referred to herein are hereby incorporated by reference in their entireties.

Having described the invention above, various modifications of the techniques, procedures, materials, and equipment will be apparent to those skilled in the art. It is intended that all such variations within the scope and spirit of the invention be included within the scope of the appended claims.

What is claimed is:

1. A dispensing assembly for dispensing plastic bags, comprising:

a rack;

a bag comprising a disposable upper portion, a lower bag portion, a front wall and a back wall and having a serration between the disposable upper portion and the lower bag portion;

a header being disposed about at least a portion of the disposable upper portion of the bag, the header being removably connected to the rack;

the bag having an opening in the lower bag portion of the bag;

a grab tab adjacent to the opening of the bag; and a member being received in the opening of the bag, the member biasing at least a portion of the grab tab away from the bag.

2. A dispensing assembly according to claim 1 wherein the member is removably attached to the rack.

* * * * *